US009388549B2

(12) United States Patent
Friedrich

(10) Patent No.: US 9,388,549 B2
(45) Date of Patent: Jul. 12, 2016

(54) QUICK-COUPLER

(71) Applicant: KINSHOFER GMBH, Waakirchen (DE)

(72) Inventor: Thomas Friedrich, Schliersee (DE)

(73) Assignee: KINSHOFER GMBH, Waakirchen (DE)

( * ) Notice: Subject to any disclaimer, the term of this patent is extended or adjusted under 35 U.S.C. 154(b) by 0 days.

(21) Appl. No.: 14/313,628

(22) Filed: Jun. 24, 2014

(65) Prior Publication Data

US 2014/0373401 A1 Dec. 25, 2014

(30) Foreign Application Priority Data

Jun. 24, 2013 (DE) ..... 20 2013 005 679 U

(51) Int. Cl.
*E02F 3/36* (2006.01)
*E02F 9/22* (2006.01)

(52) U.S. Cl.
CPC ..... *E02F 3/3663* (2013.01); *E02F 3/365* (2013.01); *E02F 3/3618* (2013.01); *E02F 3/3627* (2013.01); *E02F 3/3645* (2013.01); *E02F 9/226* (2013.01)

(58) Field of Classification Search
CPC ..... E02F 3/365; E02F 3/3663; E02F 3/3627; E02F 9/226; E02F 3/3645; E02F 3/3618
See application file for complete search history.

(56) References Cited

U.S. PATENT DOCUMENTS 8,112,914 B2 * 2/2012 Miller ..... E02F 3/3618 172/272
8,585,345 B2 * 11/2013 Sikorski et al. ..... 414/723
2010/0061799 A1 * 3/2010 Hill ..... 403/322.3
2010/0095720 A1 * 4/2010 Howarth ..... E02F 3/3622 70/174
2011/0010915 A1 * 1/2011 Calvert et al. ..... 29/428
2011/0091267 A1 * 4/2011 Hill ..... E02F 3/3618 403/31
2011/0286788 A1 * 11/2011 Sikorski et al. ..... 403/315

(Continued)

FOREIGN PATENT DOCUMENTS

DE 202012009838 U1 * 12/2013
EP 1852555 A2 11/2007

(Continued)

OTHER PUBLICATIONS

German search report dated Jun. 24, 2013, issued in corresponding DE application No. 202013005679.7 (5 pages).

*Primary Examiner* — Matthew D Troutman
(74) *Attorney, Agent, or Firm* — Westerman, Hattori, Daniels & Adrian, LLP

(57) ABSTRACT

A quick-coupler for coupling a tool such as an excavator bucket, a clamshell grapple or demolition shears to a tool guide such as an excavator arm or the like, includes a coupling mount for receiving a first locking part and a locking mount for receiving a second locking part, wherein a securing element, which can be actuated by a pressure medium, is associated with the coupling mount for capturing and/or securing the first locking part and a locking element, which can be actuated by a pressure medium, is associated with the locking mount for locking the second locking part in the locking mount. The securing element of the coupling mount can likewise be actuated by the pressure circuit for actuating the locking element of the locking mount, wherein a time control device is provided for reducing the actuation pressure built up at the securing element within a specific time duration.

10 Claims, 3 Drawing Sheets

(56) References Cited

U.S. PATENT DOCUMENTS

| | | | | |
|---|---|---|---|---|
| 2011/0308056 | A1* | 12/2011 | Doherty et al. | 29/426.1 |
| 2013/0318841 | A1* | 12/2013 | Robl | E02F 3/3618 37/468 |
| 2014/0030005 | A1* | 1/2014 | Friedrich | 403/31 |
| 2014/0294497 | A1* | 10/2014 | Robl et al. | 403/376 |
| 2014/0331663 | A1* | 11/2014 | Robl et al. | 60/435 |

FOREIGN PATENT DOCUMENTS

| | | | |
|---|---|---|---|
| EP | 2161378 | A1 | 3/2010 |
| EP | 2690223 | A2 * | 1/2014 |
| GB | 2474573 | A | 4/2011 |
| GB | 2514689 | A * | 12/2014 |
| WO | 2011/071394 | A1 | 6/2011 |
| WO | 2012/061895 | A1 | 5/2012 |

* cited by examiner

QUICK-COUPLER

The present invention relates to a quick-coupler for coupling a tool such as an excavator bucket, a clamshell grapple or demolition shears to a tool guide such as an excavator arm or the like, comprising a coupling mount for receiving a first locking part and a locking mount for receiving a second locking part, wherein a securing medium, which can be actuated by a pressure medium, is associated with the coupling mount for capturing and/or securing the first locking part in the coupling mount and a locking element, which can be actuated by a pressure medium, is associated with the locking mount for locking the second locking part in the locking mount.

BACKGROUND OF THE INVENTION

Quick-couplers are frequently used with construction machines such as hydraulic excavators or articulated grippers such as wood handling machines or demolition units or similar material transfer machinery for coupling different tools such as rakers, clamshell grapples or demolition shears to an excavator arm or similar tool guides such as articulated arm booms in order to be able to use different tools without long changeover times. Such quick-couplers can in particular have two mutually spaced apart locking axles as locking elements at a coupling part, whereas the other coupling part, in particular the coupling part at the excavator arm side can have a preferably hook-shaped coupling mount for hooking at a first one of the two locking axles and a locking mount for locking at the second locking axle. After hooking the first locking axle in the coupling mount, the two coupling parts can be pivoted with respect to one another, wherein the locking axle seated in the coupling mount forms the pivot axle so that the second locking axle moves or is pivoted into the locking mount where the named second locking axle can then be locked by a locking element such as an extendable wedge so that it is simultaneously also no longer possible to move the first locking axle out of the coupling mount. The named locking axles at the one coupling part can in this respect be formed by locking pins which can extend at the corresponding coupling part, in particular in parallel with one another, with optionally instead of such pins also other structural parts of the coupling part such as projecting noses, axle pivots, engagement stubs in the form of projections or recesses, for example in the form of pockets, being able to serve as the locking part, however, and being shape-matched to the coupling mount or to the locking mount of the other coupling part.

It has already been proposed for the prevention of the first locking axle from being released from the coupling mount again on the named pivot process after the hooking of the named first locking axle into the coupling mount to associate a securing element, for example in the form of a spring-loaded snap-in wedge, to the coupling mount, with the snap-in wedge capturing the locking axle on the hooking of the locking axle into the coupling mount and securing it in the coupling mount. On the moving of the locking axle into the coupling mount, the securing snap lock is pressed back until the completely hooked-in position is reached so that the securing snap lock can snap back again and can block the exit path from the coupling mount. To be able also to move the first locking axle or to unhook it from the coupling mount on the removal of a tool after the unlocking of the locking mount, this securing element has to be released again or has to be moved into its releasing position again. This can take place with pressure medium actuation, for example by a simply acting pressure medium cylinder which can move the securing element back into the releasing position against its spring pre-loading into the locking or blocking position. A climbing down of the machine operator or a manual actuation can hereby be avoided.

To make the actual locking mechanism, which transmits force in operation and by which the second locking element, for example in the form of a locking axle, is fixed or locked in the locking mount, independent of the actuation of the securing element associated with the coupling mount, the enabling or release of the named securing element at the coupling mount is effected by a separate pressure medium circuit which can be controlled independently of or is configured separately from the pressure medium circuit for actuating the locking mechanism. This decoupling is carried out to prevent problems at the securing element from being able to spread to the actual locking mechanism and from being able to effect an unwanted release of the coupling locking in operation. Such problems could, for example, be pressure losses at sealing elements, for example, which are provided in pressure circuit sections leading to the securing element of the coupling mount. The document EP 1852555 A2, for example, shows such a quick-coupler having mutually decoupled, separate pressure circuits for the actuation of the locking mechanism and for the unlocking of the securing element at the coupling mount.

Since in practice in the past quick-couplers of the named type, which were sold in large volumes and which are still in use today, were/are not provided with such an additional securing element at the coupling mount, it would be desirable not only to provide such an additional securing means at the coupling mount with new devices, i.e. new quick-couplers, but also to be able to retrofit them to old quick-couplers. The solution shown in the named document EP 1852555 A2 is admittedly generally also suitable for retrofitting already existing quick-couplers, but it requires three hydraulic connections due to the separate pressure circuit for actuating the securing element of the coupling mount, namely two connections for actuating the actual locking mechanism and a further pressure connection for unlocking the securing element of the coupling mount. In many cases, however, only two hydraulic connections are present at existing devices so that the retrofitting with such an additional security at the coupling mount is often not possible.

SUMMARY OF THE INVENTION

Starting from this, it is the underlying object of the present invention to provide an improved quick-coupler of the named type which avoids disadvantages of the prior art and further develops the latter in an advantageous manner. In particular, an additional security should be provided at the coupling mount which is simple to actuate and which does not require an increased number of pressure medium connections.

This object is achieved in accordance with the invention by a quick-coupler in accordance with a first aspect of the invention. Preferred embodiments of the invention are the subject of additional aspects of the invention.

It is therefore proposed to actuate the actual locking device at the locking mount of the quick-coupler which transits force in operation and to actuate the additional security at the coupling mount by a common pressure circuit and in so doing to provide a time control for the actuation of the securing element of the additional security, which time control makes the actuation of the additional security somewhat independent of the actuation of the main lock. The actuation pressure for actuating the securing element from the pressure circuit of the main lock is limited in time in order to make the securing element lockable again and thus to allow the reception of a new tool even if the main lock is still unlocked. Provision is made in accordance with the invention that the securing element of the coupling mount can likewise be actuated by the pressure circuit for actuating the locking element of the locking mount, wherein a time control device is provided for reducing the actuation pressure built up at the securing element within a specific time duration after reaching a specific actuation pressure value at the securing element. On the one hand, no additional hydraulic connections have to be provided at the machine, but the quick-coupler rather manages with the customary connections for the main lock despite the additional security at the coupling mount since the securing element can be actuated from the pressure circuit of the main lock. On the other hand, the actuation of the securing element is not slavishly dependent on the pressure relationships for controlling the main lock, whereby the quick-coupler can be utilized more efficiently. The securing element of the additional security can in particular again be made lockable after an unlocking procedure and after decoupling a tool in order to receive a new tool, even if the main lock is still unlocked. Alternatively or additionally to this faster reusability of the quick-coupler for a new receiving procedure, the named time control could also be used to decouple the additional security from the pressure circuit again depending on the design of the pressure circuit and on the connection of the additional security hereto after a locking procedure in order to avert a risk of leakage at the additional security and hereby to increase the system security overall.

The named time control device can in this respect generally have different properties, for example electronic time control modules. In an advantageous further development of the invention, however, the named time control apparatus works hydraulically and is realized by pressure control modules. The named time control device can in particular comprise a pressure store which can be filled from the pressure circuit of the main lock and which is in flow communication with a setting actuator of the securing element so that it is likewise pressurized on a loading of the setting actuator for actuating the securing element from the named pressure circuit and is filled in this process. On the other hand, the named pressure store can be emptied via an outflow control element in a pressureless section of the pressure circuit and/or via a tank of the pressure system, and indeed in particular past a pressure line via which the securing element can be acted on by pressure from the pressure circuit. The pressure store can be emptied again in a time-controlled manner by such an outflow bypass which can be controlled via an outflow control element to be able to reduce the pressure built up from the pressure circuit independently of the pressure conditions present there, in particular also when the section of the pressure circuit from where the securing element was actuated or was acted on by pressure is still pressurized.

Such an outflow control element can, for example, be a restrictor which controls the outflow rate from the pressure store, with the named restrictor advantageously being able to be configured as adjustable to be able to vary or control the named outflow rate and thus the time window for the pressure reduction at the setting actuator of the securing element.

Alternatively or additionally, the pressure store can be configured as adjustable with respect to the storage pressure and/or storage quantity to be able to control the named time window by varying the storage pressure and/or the storage quantity.

At least one outflow can lead from the named restrictor directly into the tank of the pressure system or into a section of the pressure circuit of the main lock which is itself pressureless or only has a low pressure during the application of pressure onto the securing element so that the outflow is ensured. The named outflow can in particular lead to a lock pressure connection from at the main circuit where the locking element of the locking mount can be locked. This locking pressure connection can be switched pressureless when the securing element is unlocked.

In addition to such an outflow on the pressure circuit side which is pressureless on a designated actuation of the securing element, a further outflow from the outflow control element can also lead to the other side of the pressure circuit, said further outflow being pressurized during the actuation of the securing element which should be subject to the time control. It is ensured by such an additional outflow that the pressurization of the securing element also reliably expands again on a premature switchover of the pressure conditions at the main lock.

The outflows from the named restrictor or from the corresponding outflow control element are advantageously each provided with a backflow preventer, for example in the form of a check valve, so that the corresponding outflow line can only be passed through in the outflow direction, but no pressurization of the restrictor or of the outflow element can take place from the pressure circuit.

The connection of the securing element to the pressure circuit for actuating the main lock takes place in an advantageous further development of the invention via a switching valve which blocks the pressure connection of the securing element to the common pressure circuit on a reaching of a predefined actuation pressure value at the securing element. If the securing element of the coupling mount is connected to the unlocking pressure connection of the pressure circuit via the named switching valve, for example—a connection to the locking pressure connection would also be possible depending on the configuration of the setting actuator device of the securing element, and indeed both alternatively and in addition to a connection to the unlocking pressure connection—the setting actuator of the locking element of the locking mount is first actuated on an application of the pressure to the locking pressure connection. At the same time or on reaching the end position of the setting actuator of the lock element, the setting actuator of the securing element is also actuated until it also reaches its end position, whereupon the pressure at the securing element is increased. If this actuation pressure reaches a predefined actuation pressure level, the switching valve switches over and blocks the pressurization of the securing element from the pressure circuit.

For this purpose, the switching valve can be connected to the actuation pressure side of the securing element via a control pressure line so that the actuation pressure of the securing element which builds up is applied to the switching valve as a control pressure. If this control pressure exceeds an inhibition and/or a bias force of the switching valve which can be applied, for example, by a spring engaging at the switching valve, the switching valve switches into a blocking position in which the pressure circuit no longer applies pressure to the securing element and does not further fill the pressure store. The actuation of the securing element can be made independent of the pressure conditions in the pressure circuit by this blocking. The pressure at the securing element can be reduced by means of the aforesaid time control so that it can again move into a different position by a biasing device, for example.

The named control pressure line for the pressure-controlled actuation of the switching valve can advantageously be fed from the actuation pressure side of the securing element via a check valve so that the control pressure can also be maintained at the switching valve when the actuation pressure is reduced again via the named outflow control at the securing element. In order nevertheless to be able to reduce the control pressure at the switching valve, the control pressure line can be emptied via a further check valve into a section of the pressure circuit which has pressure applied for actuating the securing element, but which can be switched pressureless in another operating state so that an outflow of the control pressure is prevented during the actuation of the securing element, but the control pressure can then be reduced in the named other operating state. The control pressure can in particular be reduced again in this manner when the unlocking pressure connection of the pressure circuit is switched pressureless, for example when the locking pressure connection of the pressure circuit is pressurized again to lock the locking element of the locking mount.

In an advantageous further development of the invention, the securing element can be configured as self-locking and/or can be biased into a preferably locking position by a biasing device and can be brought into an unlocked position from the pressure circuit. It can in particular be advantageous with such a design of the securing element if the securing element is connected to the unlocking pressure connection of the pressure circuit via the named switching valve to unlock the securing element against the bias when the main lock is also unlocked.

BRIEF DESCRIPTION OF THE DRAWINGS

The invention will be explained in more detail in the following with reference to a preferred embodiment and to associated drawings. There are shown in the drawings.

DETAILED DESCRIPTION OF THE INVENTION

Figure 1:
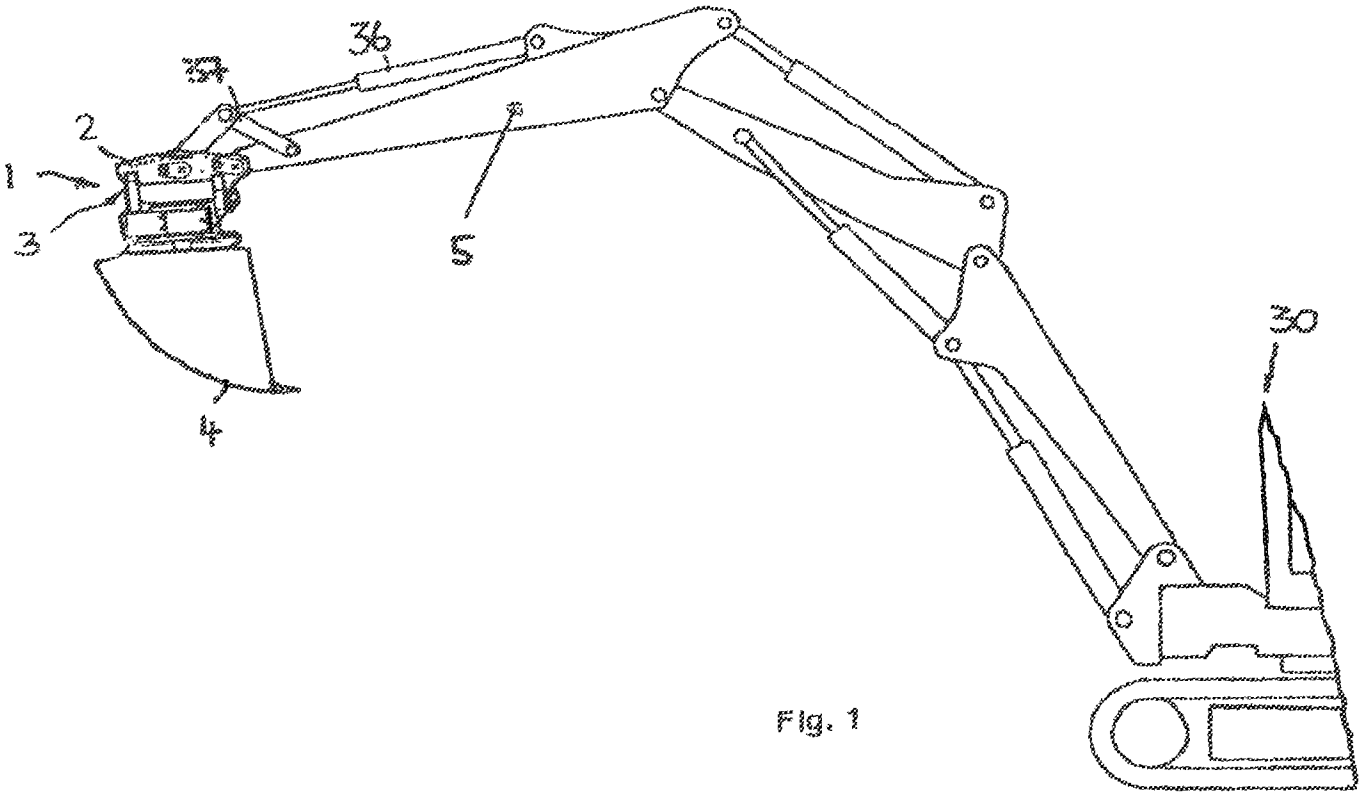
FIG. 1: a schematic side view of a quick-coupler in accordance with an advantageous embodiment of the invention which is attached to a boom arm of an excavator and couples an excavator bucket as an installation tool.

As FIG. 1 shows, the quick-coupler 1 can be installed between the free end of the boom arm 5 of an excavator 30 and the tool 4 to be installed thereat, wherein the named installation tool 4 is configured as an excavation bucket in FIG. 1, but which can typically naturally also comprise other corresponding construction tools, handling tools or demolition tools, for example in the form of clamshell grapples, demolition shears, shears or similar. The named quick-coupler 1 is in this respect, on the one hand, be mounted to the named boom arm 5 by means of a coupler part 2 at the arm side pivotable about a lying pivot axis aligned transversely to the longitudinal axis of the boom arm 5 so that the quick-coupler 1 can be pivoted together with the tool 4 installed thereat, for example by means of a pressure medium cylinder 36 and an interposed pivot piece 37, with respect to the boom arm 5.

Figure 2:
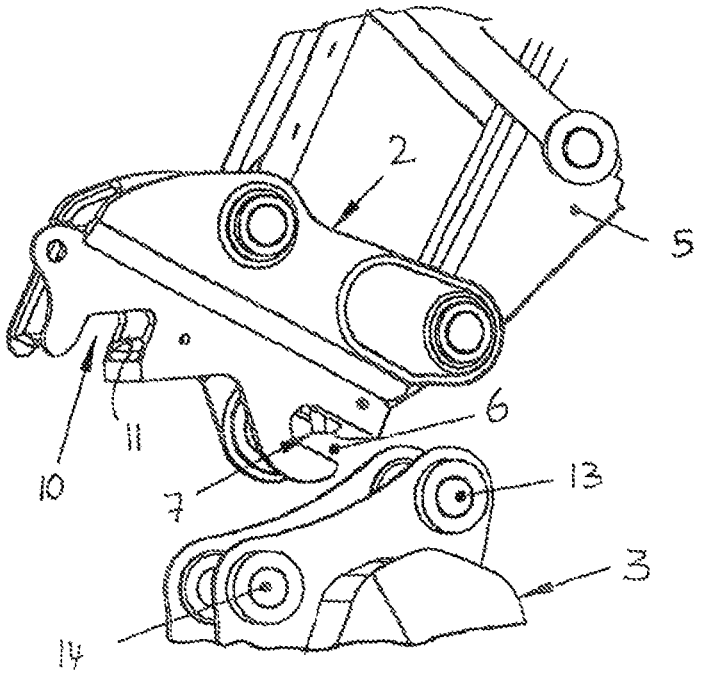
FIG. 2: a perspective representation of the quick-coupler of FIG. 1 in a decoupled position in which the two mutually couplable coupling parts are shown just before the hooking in at the hook section.

The named quick-coupler can, on the other hand, be installed by means of a tool-side coupler part 3—cf. FIG. 2—to the installation tool 4 and/or to an interposed rotational drive.

Figure 3:
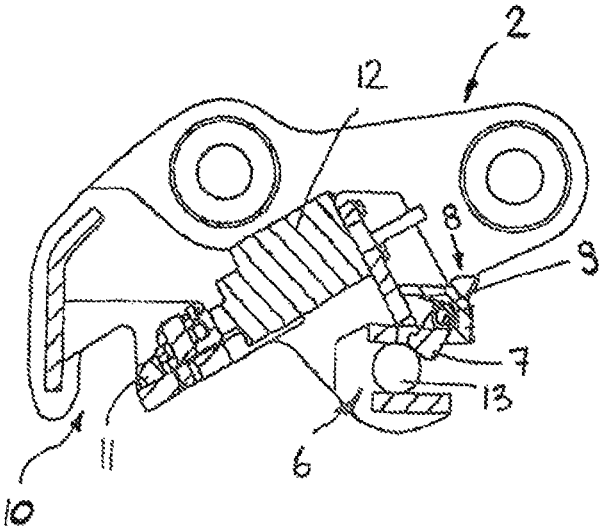
FIG. 3: a sectional view through the coupling part of the quick-coupler of the preceding Figures which shows the coupling mount and the locking mount as well as the associated securing and locking elements and their setting actuators.

As FIGS. 2 and 3 show, one of the two coupling parts 2 and 3 respectively, preferably the coupler part 2 at the arm side, can comprise a coupling mount 6, on the one hand, and a locking mount 10, on the other hand, which can be hooked in or brought into engagement at the other coupler part 3, preferably at the tool side, with two locking parts, for example in the form of locking axles 13 and 14. Contrary to the representation of the drawing, it would, however, generally also be conceivable to provide a locking axle and a mount at one coupler part and in turn to provide a locking axle and a mount at the other coupler part, with the embodiment shown with two mounts, i.e. a locking mount and a coupling mount at the one coupler part and two locking axles corresponding thereto at the other coupler part, being preferred, however, since the associated securing elements and locking elements and their actuation can then be combined at one coupler part.

As FIG. 2 shows, the coupling mount 6 and the locking mount 10 each form a mouth-shaped mount which is open toward a side and into which the locking axles 13 and 14 can move which can be formed by cross-pins or locking pins, cf. FIG. 2. In this respect, the coupling mount 6 and the locking mount 10 are advantageously arranged and configured such that when a first locking axle 13 of the one coupler part 3 have moved into or is hooked into the preferably hook-shaped coupling mount 6 of the other coupling part 2, the two coupler parts can be pivoted with respect to one another, and indeed such that the coupling mount 6 and the locking axle 13 received therein form the axis of rotation and the second locking axle 14 can move into the locking mount 10 by the corresponding pivot movement so that the two coupling parts 2 and can be coupled to one another in a two-stage coupling process. The coupling mount 6 is first hooked at the first locking axle 13 so that then the locking mount 10 can be brought into engagement with the second locking axle 14 by pivoting the two coupler parts 2 and 3 relative to one another—which can take place, for example, by actuating the aforesaid pivot cylinder 36.

If the second locking axle 14 is moved into the locking mount 10, the named second locking axle 14 is locked in the locking mount 10 or the locking mount 10 is closed so that the second locking axle 14 can no longer move out. For this purpose, a locking element 11 is provided, for example in the form of a locking wedge, which can be moved on the opening side of the locking mount 10 in front of the locking axle 14 received therein, cf. FIG. 3. To actuate the named locking element 11, a hydraulically actuable setting actuator 12 is advantageously provided in this respect which is connected directly or indirectly to the named locking element 11 and is advantageously configured in dual action so that it can be moved forward and backward.

Not only is the second locking axle 14 in this respect held in the locking mount 10 by locking the locking element 11, but the two coupler parts 2 and 3 are also locked to one another since the coupling mount 6 is configured such that the first locking axle 13 received therein cannot move out of the coupling mount 6 when the second locking axle 14 is captured in the locking mount 10. For example, the coupling mount 6 can have a mouth opening which faces away from the locking mount 10.

The named coupling mount 6 nevertheless has a securing element 7 associated with it by means of which the first locking axle 13 or a suitable locking part can be captured or can be secured or can be blocked in the coupling mount 6 so that the first locking axle 13 cannot unintentionally slip out of the coupling mount 6. This securing element 7 primarily serves to prevent an unintentional sliding of the first locking axle 13 out of the coupling mount 6 during the aforesaid pivot movement on the coupling process as long as the two coupler parts 2 and 3 are still not locked to one another by closing the named locking element 11.

The named securing element 7 can likewise be a wedge-shaped slider or also, as FIG. 3 shows, a pivotably supported locking lever which tapers or blocks the opening of the coupling mount 6 so much in its locked position that the first locking axle 13 cannot slide out, cf. FIG. 3. The named securing element 7 is in this respect advantageously configured as a self-locking catch which is biased into the locking position by a biasing apparatus, in particular in the form of a spring 9, but can be automatically compressed on the moving of the first locking axle 13 into the coupling mount 6. If the locking axle 13 is moved completely or sufficiently far into the coupling mount 6, the securing element 7 can snap back into the locking position, driven by the spring 9, so that the locking axle 13 is captured.

To release the securing element 7 for the purpose of the decoupling, a setting actuator 8 in the form of a simply acting hydraulic cylinder is associated with the named securing element 7, by means of which setting actuator the securing element 7 can be moved or pivoted into its releasing position.

Figure 4:
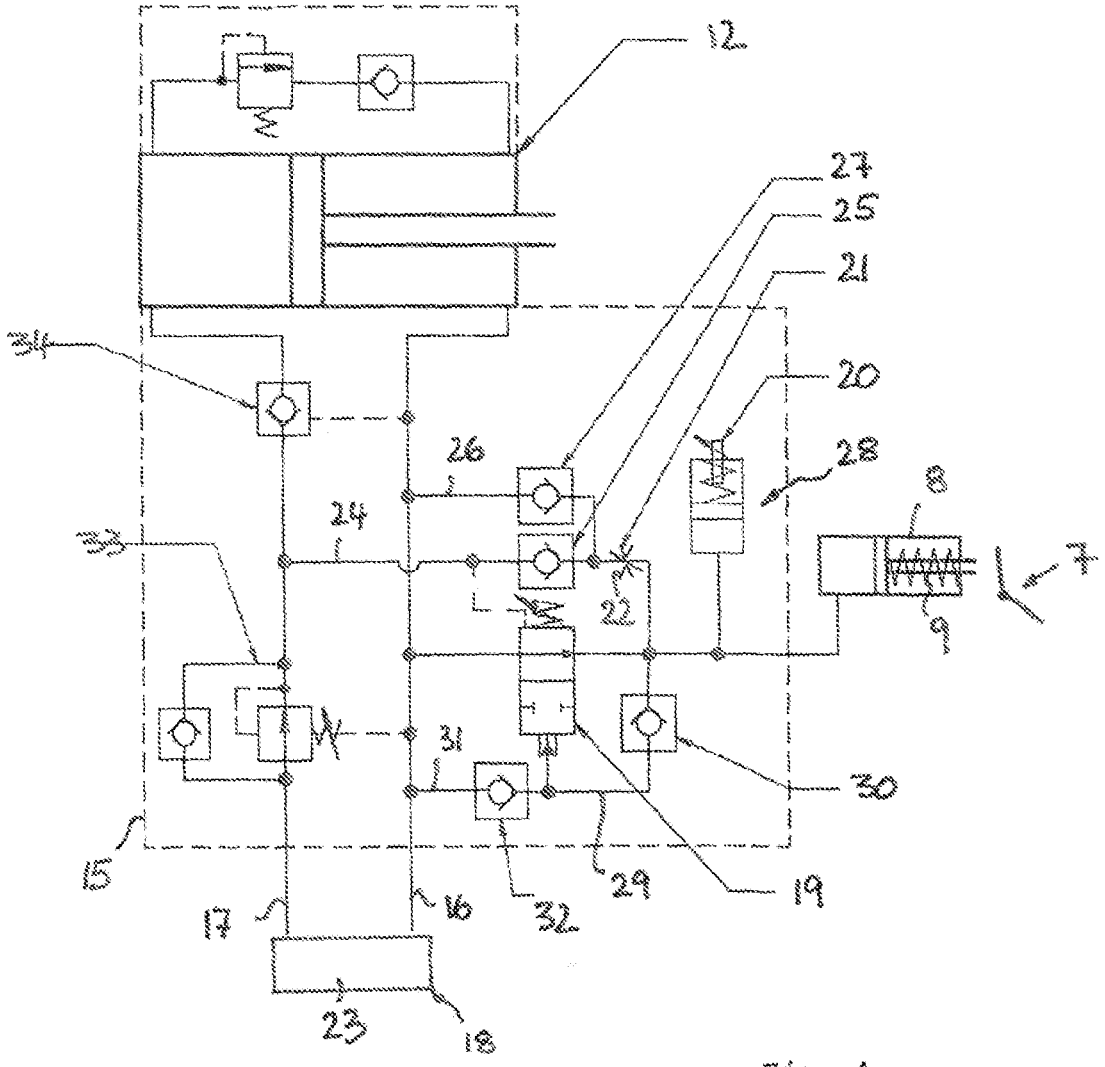
FIG. 4: a circuit diagram of the common pressure circuit for actuating the securing element associated with the coupling mount and the lock element associated with the locking mount.

FIG. 4 shows the control of the two named securing and locking elements 7 and 11 by a common pressure circuit 15. The pressure circuit 15 is in this respect connected, on the one hand, to a pressure source, for example in the form of a pump, by means of which the pressure circuit 15 is fed with pressure fluid, in particular hydraulic fluid, and is connected, on the other hand, to a tank into which pressure fluid can flow back. On the other hand, the pressure circuit 15 comprises two pressure connections, namely a locking pressure connection 17, on the one hand, and an unlocking pressure connection 16, on the other hand, to which the dual-action setting actuator 12 of the locking element 11 is connected to be able to release and close the locking of the quick-coupler 1, i.e. to be able to lock and unlock the second locking axle 14 in the locking mount 10. To be able to control this main locking process or unlocking process, the pressure circuit 15 comprises a valve device 18 by means of which the unlocking pressure connection 16 or the locking pressure connection 17 can selectively be connected to the pressure source.

As FIG. 4 shows, the valve device 18 comprises a primary switching valve 23 for this purpose which, in a switching position, switches the pressure line coming from the pressure source through to the locking pressure connection 17 and the unlocking pressure connection 16 through to the tank and, in another switching position, conversely connects the line coming from the pressure source to the unlocking pressure connection 16 and the locking pressure connection 17 to the tank.

The at least one setting actuator 8 provided for actuating the securing element 7 is connected via a pressure switching valve 19 to the unlocking pressure connection 16. As FIG. 4 shows, the named switching valve 19 can be a 2/2 switching valve which switches the unlocking pressure connection 16 through to the unlocking chamber of the setting actuator 8 of the securing element 7 in a first switching position and blocks the named connection between the unlocking pressure connection 16 and the setting actuator 8 in a second position.

In this respect a pressure store 20 is connected in parallel with the setting actuator 8 and can be connected between the setting actuator 8 and the switching valve 19 to the pressure line via which pressure is applied to the setting actuator 8. The named pressure store 20 can advantageously be configured as adjustable, for example such that it expands at a pressure of 50 bar and absorbs fluid.

To allow a pressure reduction at the setting actuator 8 of the securing element 7 and also an emptying of the pressure store 20 with a blocked switching valve 10, an outflow is provided which can be connected to the named pressure line between the switching valve 19 and the setting actuator 8, but could optionally also branch off from the pressure store 20 itself or from the setting actuator 8 itself. The named outflow comprises an outflow control 21 having a controllable or adjustable restrictor 22 via which the outflow rate can be controlled.

The fluid can flow off via the named outflow control 21 via an outflow line 24 to the locking pressure connection 17, with optionally also a direct outflow into the tank of the system being able to be provided. On connection to the locking pressure connection 17, a backflow preventer is advantageously provided, for example in the form of a check valve 25, to prevent the outflow control 21 from being pressurized from the pressure circuit 14 with pressure on the locking pressure connection 17.

As FIG. 4 shows, a further outflow channel can also lead from the named outflow control 21 to the unlocking pressure connection side, with here the outflow line 26 also advantageously being equipped with a backflow preventer, for example in the form of a check valve 27, to prevent an application of pressure on the outflow control 21 from the unlocking pressure connection side with a pressurized unlocking pressure connection 16. This additional pressure outflow ensures that the setting actuator 8 of the securing element 7 can relax even with too fast a switchover or an unintentional switchover and reapplication of pressure to the locking side.

The above-named pressure store 20 forms together with the outflow control 21 a time control apparatus 28 which defines a time window for the open position of the securing element 7 as will still be explained.

The switching valve 19 is switched over with pressure control. For this purpose, a control pressure line 29 is provided which connects the control pressure input of the switching valve 19 to the pressure line between the switching valve 19 and the setting actuator 8 of the securing element, but can also be connected to the named setting actuator itself or to the pressure store 20. The actuation pressure applied to the setting actuator 8 of the securing element 7 is provided as control pressure to the switching valve 19 via the named control pressure line 29. In this respect a check vale 30 is present in the named control pressure line 29 and prevents the reduction of the control pressure when the actuation pressure in the setting actuator 8 and/or in the pressure store 20 falls.

On the other hand, the control pressure line 29 is connected to the unlocking pressure connection 16 via an outflow line 31, with a further check valve 32 or a further backflow preventer being provided in this outflow line 31 to prevent an application of unlocking pressure to the control pressure line 29 past the switching valve 19.

It is in particular possible to work with the quick-coupler 1 as follows: In the starting situation shown in FIG. 4, the quick-coupler 1 is coupled and locked, i.e. both locking axles 13 and 14 are received in the respective mounts 6 and 10 and are locked there. In this respect, the switching valve 23 is connected such that pressure is applied to the locking pressure connection 17 so that the setting actuator 12 of the locking element 11 is locked at the locking mount 10. The locking pressure of the locking pressure connection 17 can be applied via a pressure reduction valve 33 and a check valve 34 into the locking chamber of the setting actuator 12.

In the named locking configuration of the quick-coupler 1, the switching valve 19 is connected through so that pressure which may previously have been present in the setting actuator 8 of the securing element 7 can reduce toward the unlocking pressure connection 16 which is switched pressureless in the locking state. Pressure which may previously have been present in the pressure store 20 can equally reduce into the unlocking pressure connection 16.

If the quick-coupler 1 should now be opened, the switching valve 23 is switched over to apply the system pressure to the unlocking pressure connection 16. The setting actuator 12 of the main lock hereby moves while the previously pressurized locking pressure connection is connected to the tank.

That hydraulic pressure is first adopted at the locking pressure connection 17 or at the pressure line leading into the unlocking chamber of the setting actuator 12 which is required for overcoming the friction forces at the setting actuator 12 and the locking element 11 associated therewith. An opening of the securing element 7 can hereby also occur, but does not have to occur.

However, at the latest when the setting actuator 12 reaches its end position, the pressure in the unlocking pressure line 16 increases, whereby the pressure at the setting actuator 8 of the securing element 7 also rises, whereby the securing element 7 is opened. In parallel with this, pressure builds up at the pressure store 20 or the pressure store 20 is filled.

If the setting actuator 8 of the securing element 7 has been completely moved or has reached its end position, such a high pressure is built up in the control pressure line 29 which then switches over the switching valve 19 into its blocking position. The control pressure in the control pressure line 29 is maintained in this respect since the two check valves 25 and 27 block—at least as long as the unlocking pressure connection 16 has pressure applied.

In this blocked position of the switching valve 19, a more or less slow pressure reduction then takes place at the setting actuator 8 of the securing element 7. The pressure fluid stored in the pressure store 20 can flow off via the outflow restrictor 22 and via the outflow line 24, and indeed toward the locking pressure connection 17 which is connected to the tank and is pressureless. Depending on the set position or on the throughflow rate of the restrictor 22, this pressure reduction takes more or less long, whereby the time duration up to the relocking of the securing element 7 is controlled. If the pressure store 20 is empty, the spring 9 can push back the setting actuator 8, whereby the securing element 7 snaps closed again. At least the coupling mount 6 is hereby again ready to receive a new tool. A machine operator can take up a new tool or its first locking axle 13 into the coupling mount 6, with the securing catch or the securing element 7 being pressed open briefly against the spring force and then snaps closed again when the locking axle 13 has been completely moved in.

In the next step, the second locking axle 14 can then be moved into the locking mount 10 where it can be locked by the locking element 11. The switching valve 23 switches over for this purpose in order again to apply pressure to the locking pressure side 17 of the pressure circuit 15. At the same time, the unlocking pressure side 16 is switched pressureless, whereby the control pressure still present in the control pressure line 29 can reduce. The check valve 32 opens for this purpose so that the control pressure can flow out via the outflow line 31.

The invention claimed is:

1. A quick-coupler for coupling a tool to an excavator arm, comprising:

a coupling mount for receiving a first locking part of the tool, and a locking mount for receiving a second locking part of the tool, wherein a securing element is associated with the coupling mount for capturing and/or securing the first locking part in the coupling mount, wherein a locking element is associated with the locking mount for locking the second locking part in the locking mount, wherein the locking element is configured to be actuated by a pressure circuit which has an unlocking pressure connection and a locking pressure connection, the locking pressure connection and the unlocking pressure connection being selectively connectable to a pressure source or to a return line, via a valve device, wherein the securing element of the coupling mount is configured to be actuated by the pressure circuit, and wherein the quick-coupler further comprises a time control device which reduces the actuation pressure built up at the securing element within a specific time duration after reaching a specific actuation pressure value at the securing element.

2. A quick-coupler in accordance with claim 1, wherein the time control device comprises a pressure store configured to be filled by a pressure circuit in flow communication with a setting actuator of the securing element, and wherein the pressure store is configured to be emptied via an outflow control element into a pressureless section of the pressure circuit and/or into a tank.

3. A quick-coupler in accordance with claim 2, wherein the outflow control element comprises an adjustable restrictor.

4. A quick-coupler in accordance with claim 2, wherein the pressure store is adjustable with respect to its receivable volume and/or with respect to its storage pressure.

5. A quick-coupler in accordance with claim 3, wherein the outflow control element is connected via two outflow lines respectively equipped with a backflow preventer to an unlocking pressure connection and to a locking pressure connection of the pressure circuit.

6. A quick-coupler in accordance with claim 1, wherein the securing element is connected to the pressure circuit via a switching valve which blocks pressure application to the securing element from the pressure circuit automatically upon reaching a predefined actuation pressure at the securing element.

7. A quick-coupler in accordance with claim 6, wherein the switching valve is connected to the actuation pressure side of the securing element via a control pressure line so that the actuation pressure of the securing element is configured to be applied to the switching valve as control pressure.

8. A quick-coupler in accordance with claim 7, wherein the control pressure line is configured to be fed in via a first check valve from the actuation pressure side of the securing element and is configured to be emptied via a second check valve into a section of the pressure circuit which has pressure applied on actuation of the securing element.

9. A quick-coupler in accordance with claim 6, wherein the switching valve of the securing element is connected to an unlocking pressure connection of the pressure circuit.

10. A quick-coupler in accordance with claim 1, wherein the securing element is biased by a biasing apparatus into a locking position, wherein the securing element is automatically self-locking and is configured to be brought into an unlocked position by pressure from the pressure circuit.

* * * * *